US007736274B2

(12) United States Patent
Thibodeaux, Sr.

(10) Patent No.: US 7,736,274 B2
(45) Date of Patent: Jun. 15, 2010

(54) POLE VAULTING DEVICE AND METHOD

(76) Inventor: Gene Thibodeaux, Sr., 8738 Helen Dr., Youngsville, LA (US) 70592

( * ) Notice: Subject to any disclaimer, the term of this patent is extended or adjusted under 35 U.S.C. 154(b) by 0 days.

(21) Appl. No.: 12/321,045

(22) Filed: Jan. 15, 2009

(65) Prior Publication Data

US 2009/0163324 A1 Jun. 25, 2009

Related U.S. Application Data

(63) Continuation of application No. 11/242,703, filed on Oct. 4, 2005, now abandoned.

(51) Int. Cl.
*A63B 5/00* (2006.01)
*A63B 5/16* (2006.01)
*A63K 3/04* (2006.01)

(52) U.S. Cl. ..... 482/15

(58) Field of Classification Search ..... 482/14–15, 482/18, 35–37, 27; D21/800, 797, 705
See application file for complete search history.

(56) References Cited

U.S. PATENT DOCUMENTS

| | | | | | |
|---|---|---|---|---|---|
| 2,588,722 | A | * | 3/1952 | Hendershott | 482/15 |
| 3,105,682 | A | * | 10/1963 | Ahrens | 482/17 |
| 3,513,491 | A | | 5/1970 | Gordon | |
| 3,948,515 | A | * | 4/1976 | McNeil | 482/27 |
| 3,948,518 | A | | 4/1976 | Tebbetts, Jr. | |
| 4,168,061 | A | | 9/1979 | Gordon | |
| 4,245,838 | A | * | 1/1981 | Gordon | 482/17 |
| 4,351,413 | A | * | 9/1982 | Simon | 182/139 |
| 4,433,838 | A | * | 2/1984 | Gordon | 473/473 |
| 4,443,009 | A | * | 4/1984 | Smith | 482/18 |
| 5,050,867 | A | * | 9/1991 | Rand et al. | 482/15 |
| 5,378,588 | A | | 1/1995 | Tsuchiya | |
| 5,738,588 | A | * | 4/1998 | Esser | 472/92 |
| 5,937,586 | A | * | 8/1999 | Scherba | 52/2.23 |
| 5,941,798 | A | * | 8/1999 | Coan et al. | 482/27 |
| D420,714 | S | * | 2/2000 | Ivanov | D21/705 |
| 6,053,845 | A | * | 4/2000 | Publicover et al. | 482/35 |
| 6,093,134 | A | * | 7/2000 | Worsham | 482/35 |
| 6,261,207 | B1 | | 7/2001 | Publicover et al. | |
| 6,394,918 | B1 | * | 5/2002 | Erhard | 473/421 |
| 6,607,468 | B1 | * | 8/2003 | Nichols et al. | 482/27 |
| 2004/0053747 | A1 | | 3/2004 | Bollinger | |
| 2004/0121883 | A1 | | 6/2004 | Publicover et al. | |
| 2004/0198556 | A1 | * | 10/2004 | Rastegar | 482/15 |
| 2006/0194637 | A1 | * | 8/2006 | Gottfried | 472/92 |

FOREIGN PATENT DOCUMENTS

| | | | | |
|---|---|---|---|---|
| DE | 3135902 | A1 | * | 3/1983 |
| DE | 3640251 | A1 | * | 7/1988 |

* cited by examiner

*Primary Examiner*—Loan H Thanh
*Assistant Examiner*—Sundhara M Ganesan
(74) *Attorney, Agent, or Firm*—Jones Walker

(57) ABSTRACT

A pole vaulting device and method. The device includes a mat having a top side and an underside, a plurality of support poles positioned about the mat, with the plurality of support poles having a first end having a curved portion oriented in the direction of the mat, and a net having an outer periphery, and wherein the net's outer periphery is attached to the curved portion of the plurality of support poles. The pole vaulting device may further include a plurality of straps having a distal end attached to the underside of the mat and a proximal end attached to the net so that the net forms a bowl section.

18 Claims, 8 Drawing Sheets

POLE VAULTING DEVICE AND METHOD

CROSS-REFERENCE TO RELATED APPLICATIONS

This application is a continuation of and claims priority to U.S. patent application Ser. No. 11/242,703, filed on Oct. 4, 2005 now abandoned.

FIELD OF THE INVENTION

This invention relates to a pole vaulting device. More specifically, but not by way of limitation, this invention relates to a pole vaulting net device and method.

BACKGROUND OF THE INVENTION

Pole vaulting is an exciting, challenging sport. In the early days of the sport, the poles utilized were made of bamboo and the pit contained saw dust. Now, the poles are made of high tech synthetic plastics and the pits contain mats. The poles are longer and stronger, and the athletes are jumping ever higher distances. As those active in the sport will recognize, greater heights entail greater risk.

One of the most common injuries are those associated with the pole vaulter landing improperly onto the mat. In other words, after the pole vaulter utilizes the pole to vault him (or her) into the air, the pole vaulter may land in such a way that causes serious injuries to him (or her). For instance, the pole vaulter may land face forward in the vaulter's planting box, or the pole vaulter may completely miss the mat, or the pole vaulter may bounce off the mat and onto the ground. This list is illustrative. Since 1971, there have been at least 45 catastrophic injuries or deaths which have occurred due to pole vaulting activities.

Prior art vaulting techniques include utilization of mats. However, this safety technique requires the horizontal application of mats, which may be cost prohibitive. Additionally, many track and field areas have limited space thereby limiting the usefulness of large horizontal mats. Further, some prior art techniques use specialized mats. However, these designs still require the application of horizontal mat placement to solve the problem. Further, these prior art designs are awkward and expensive.

Therefore, there is a need for a device that will allow for safer pole vaulting. There is also a need that will allow for a netting device for use in pole vaulting. There is also a need for a pole vaulting device that can distribute the forces caused by the falling and bouncing athlete. These needs, and many others, will be met by the following disclosure.

SUMMARY OF THE INVENTION

A pole vaulting device is disclosed. The pole vaulting device comprises a mat positioned on the base frame, with the mat having a top side and an underside, and a plurality of support poles positioned about the mat, with the plurality of support poles having a first end. The pole vaulting safety device further includes a net having an outer periphery, and wherein the net outer periphery is attached to the plurality of support poles, and a plurality of straps having a distal end attached to the underside of the mat, and a proximal end attached to the net so that the net forms a bowl section.

The pole vaulting device may further include a base frame having a longitudinal member and a latitudinal member. In one preferred embodiment, the longitudinal member comprises a plurality of variable length beams, and the latitudinal member comprises a plurality of variable length beams. Also, the plurality of support poles may have a second end that is selectively attachable to the base frame. In the most preferred embodiment, the first end of the plurality of support poles has a curved portion, and wherein the curved portion is oriented in the direction of the mat. The pole vaulting device may further comprise a secondary strap attaching the net to the top side of the mat. The support poles may be disposed within a stand that is operatively attached to the longitudinal member and the latitudinal member i.e. members attached to the channel bar segments. The stand has a tubular sleeve that receives the support poles, and wherein the tubular sleeve is attached to a top side of the longitudinal and latitudinal members.

A device used for pole vaulting over a bar and onto a mat, with the mat having a top side and an underside, the mat surrounded by a net having an outer periphery, is also disclosed. The device comprises a plurality of support poles positioned about the mat, said plurality of support poles having a first end, and wherein the net outer periphery is attached to the plurality of support poles. The device further includes a plurality of straps having a distal end attached to the underside of the mat, and a proximal end attached to said net so that the net forms a bowl section, and a base frame having a longitudinal member and a latitudinal member, the mat being positioned on the base frame.

A method of distributing the force of a pole vaulter against a net is also disclosed. The method comprises providing a device, the device includes: a mat positioned on a base frame; a plurality of support poles positioned about the mat; a net having an outer periphery, and wherein the net outer periphery is attached to a curved portion of the support poles; a plurality of straps having a distal end attached to an underside of the mat, and a proximal end attached to the net so that the net forms a bowl section.

The method further includes landing the pole vaulter on the mat and applying the force against the first side of the net caused by the pole vaulter bouncing from the mat and into the first side of the bowl section, wherein the force is created by the pole vaulter's weight acting against the first side of the bowl section. The method further includes distributing the force, caused by the pole vaulter's weight, to the support poles, then distributing the force, caused by the pole vaulter's weight, to the plurality of straps, and in turn, distributing the force to the underside of the mat.

In one preferred embodiment, the device further comprises a secondary strap attaching the net to a top side of the mat, and the step of distributing the force of the pole vaulter's weight to the underside of the mat further includes distributing the force caused by the pole vaulter's weight to the top side of the mat via the secondary strap.

An advantage of the present invention is that the device can be used to help prevent injuries from pole vaulting. Another advantage is that the device can be used to safely catch the vaulter. Another advantage is that the device can be used as a safety net. Another advantage is that the device can be used in areas of limited space. Yet another advantage is that the device is easily disassembled and moved. Another advantage is that the invention can be used with existing safety equipment i.e. prior art mats. Still yet another advantage is that the device is economical to manufacture.

A feature of the present invention is the curved support poles which attach to the net. Another feature is that the net, once installed, forms a bowl section. Yet another feature is that the net is attached to the underside of mat so that the weight of the mat acts as an anchor. Another feature is the variable width and length of the base frame. Still yet another feature is the selectively attachable stands for the support poles.

DETAILED DESCRIPTION OF THE PREFERRED EMBODIMENTS

Figure 1A:
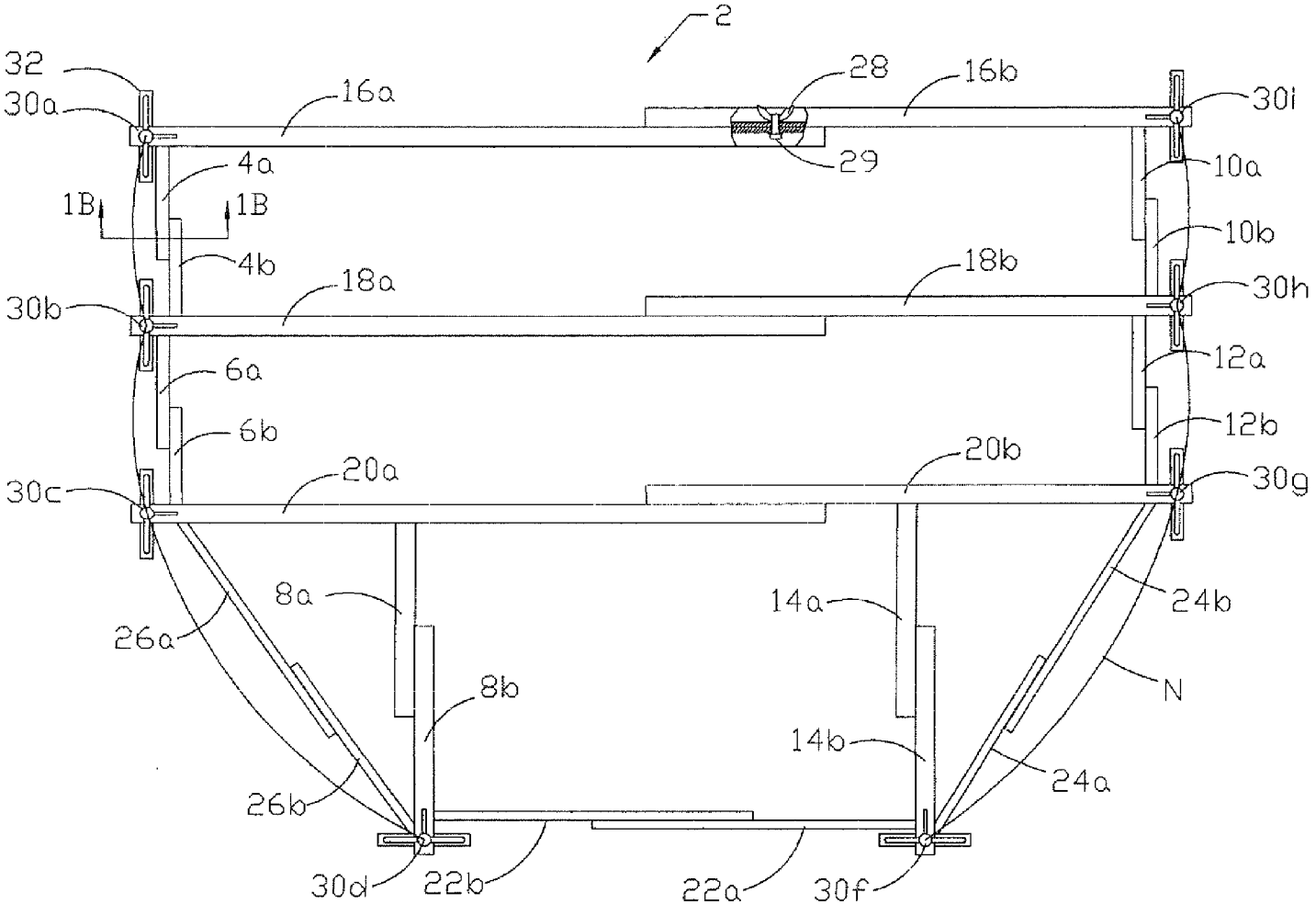
FIG. 1A is a top view of the preferred embodiment of the base frame for the present invention.

Referring now to FIG. 1A, a top view of the preferred embodiment of the base frame 2 for the present invention will be described. The base frame 2 may sometimes be referred to as the grid 2. The base frame 2 includes a longitudinal beam means (sometimes referred to as length), a latitudinal beam means (sometimes referred to as width) and diagonal beam members. The longitudinal beam, the latitudinal beam, and the diagonal beams, in the most preferred embodiment, are channel bar segments, as will be more fully explained later in the application. The longitudinal beam means contains member 4*a*, member 4*b*, member 6*a*, member 6*b*, member 8*a* and member 8*b*, wherein members 4*a* and 4*b* cooperate to form a first variable length beam, members 6*a* and 6*b* cooperate to form a second variable length beam, and members 8*a* and 8*b* cooperate to form a third variable length beam. On the opposite side, the longitudinal beam means contains the member 10*a*, member 10*b*, member 12*a*, member 12*b*, member 14*a*, and member 14*b*, wherein members 10*a* and 10*b* cooperate to form a fourth variable length beam, members 12*a*, 12*b* cooperate to form a fifth variable length beam, and members 14*a*, 14*b* cooperate to form a sixth variable length beam.

The latitudinal beam means contains member 16*a*, member 16*b*, member 18*a*, member 18*b*, member 20*a*, member 20*b*, member 22*a*, and member 22*b*. The beam means also include the diagonal variable length beams that include member 22*b*, member 24*a*, and member 24*b*, member 26*a* and member 26*b*. As seen in FIG. 1A, members 16*a* and 16*b* form a seventh variable length beam, members 18*a* and 18*b* form an eight variable length beam, members 20*a* and 20*b* form a ninth variable length beam, members 22*a* and 22*b* form a tenth variable length beam. The members 24*a* and 24*b* form a variable length beam, and members 26*a*, 26*b* form a diagonal variable length beam.

Figure 1B:
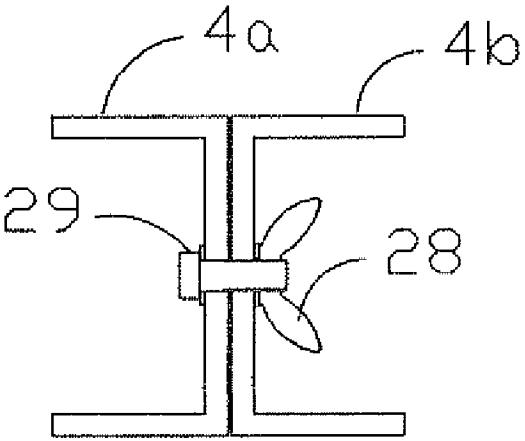
FIG. 1B is an expanded, rotated view of a channel bar beam seen in FIG. 1A.
Figure 1C:
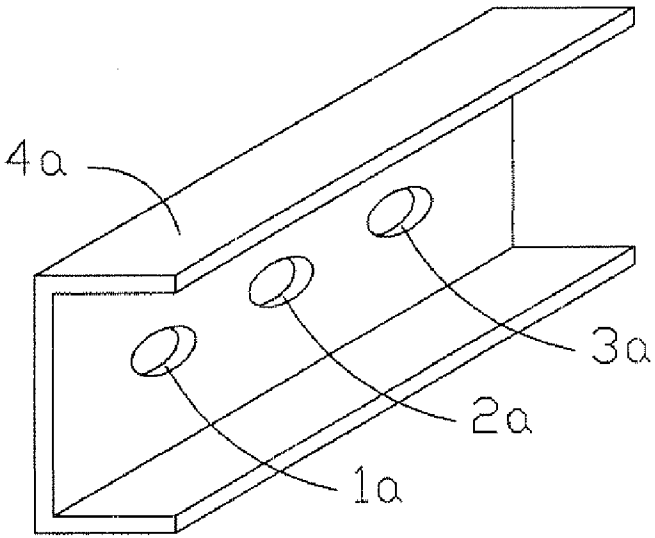
FIG. 1C is a partial perspective view of one of the channel bar beams seen in FIG. 1B.

Referring now to FIG. 1B, an expanded, rotated view of the channel bar beam seen in FIG. 1A taken along line 1B-1B will now be described. More specifically in FIG. 1B, the member 4*a* and member 4*b* are shown, and wherein the members 4*a*/4*b* are channel bar segments as noted earlier. Additionally, the wing nut 28 and bolt 29 are shown disposed through perforated apertures in the channel bar segments. In the preferred embodiment, each individual length beam member will be slidably connected in this way. Another variable length arrangement may be used that includes a tongue in groove arrangement. For instance members 4*a* and 4*b* may be slidably connected by a tongue in groove arrangement, and can be fastened by fastener means such as a screw and wing nut (the tongue and groove embodiment not shown). Referring now to FIG. 1C, a partial perspective view of the beam member (channel bar segment) 4*a* is shown, along with apertures, such as 1*a*, 2*a*, 3*a*, for placement of the wing nuts and bolts. Hence, the length of the beams can be varied and are therefore adjustable in length.

Returning to FIG. 1A, FIG. 1A depicts member 4*a* and member 16*a* are connected by conventional means such as nuts and bolts, seen generally at 28. FIG. 1A shows the stands, such as stand 32. FIG. 1A further depicts the cylindrical sleeve of the stand 32 which the support poles can be placed therein. The support poles and stands will be described later in the application. Hence, FIG. 1A depicts the openings 30*a*, 30*b*, 30*c*, 30*d*, 30*f*, 30*g*, 30*h*, 30*i* of the various stands for placement of the support poles. FIG. 1A also depicts the contour of the net N, as will be more fully explained later in the application.

As per the teachings of the present invention, the base frame 2 is constructed so as to make it possible to vary the length and width in order to accommodate various size mats. Hence, an operator can adjust the length of each beam by simply sliding or expanding members, and thereafter bolting the cooperating members together. For instance, member 4*a* and member 4*b* can be shortened by simply sliding the two members together, as well as sliding members 10*a* and 10*b* together. Additionally, with the design of the present invention, the base frame 2 can be disassembled after use and moved to another location or stored.

Figure 2B:
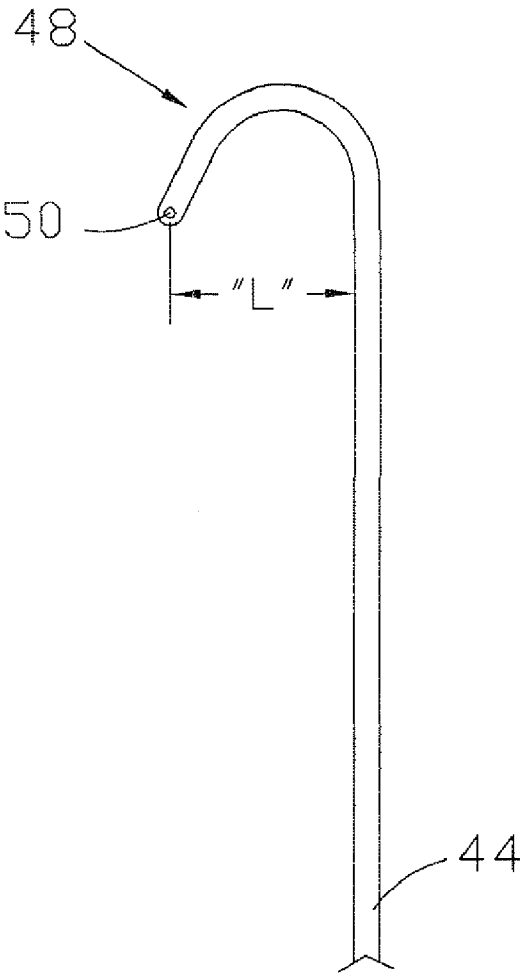
FIG. 2B is a partial side view of the support pole seen in FIG. 2A.
Figure 2A:
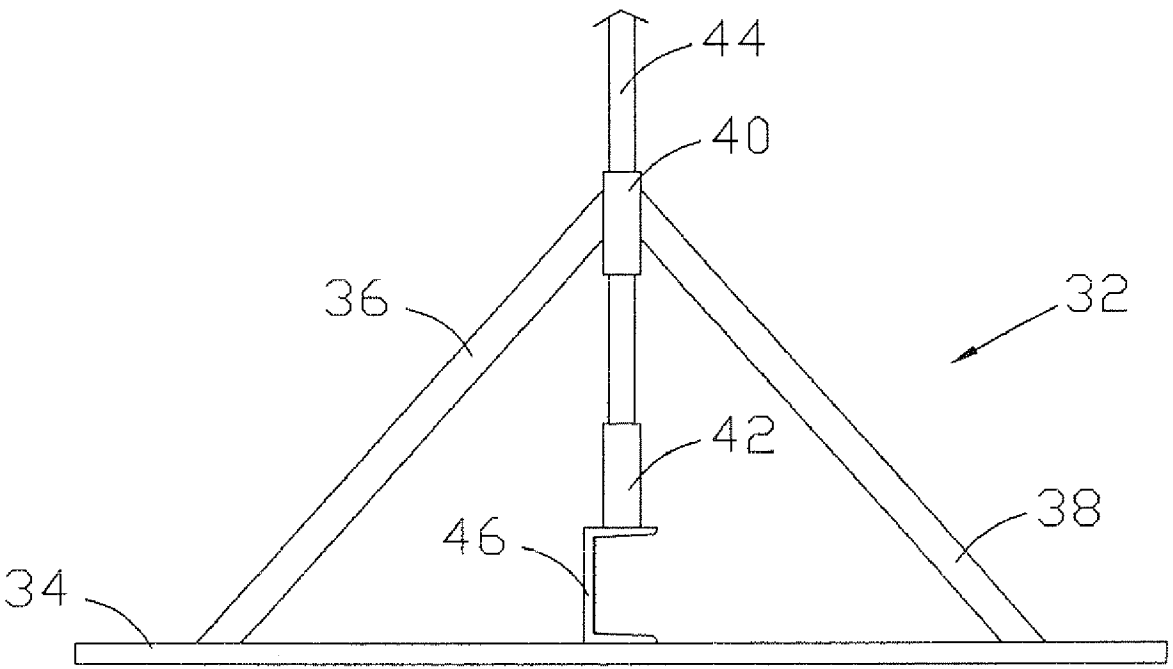
FIG. 2A is a partial side view of the preferred embodiment of the stand support and support pole for the present invention.

Referring now to FIG. 2A, a partial side view of the preferred embodiment of the support pole and stand of the present invention will now be described. Generally, the stand 32 has a base 34 that has two (2) supporting braces 36, 38, as well as the tubular sleeves 40, 42 which will have the cylindrical pole 44 disposed there through. The cylindrical pole 44 is sometimes referred to as the support pole. The tubular sleeve 42 is attached on top of channel bar segment 46; braces 36, 38 attach to sleeve 40. Channel bar segment 46 is used, along with the tubular sleeve 40 and 42 to attach the pole 44 to the frame 2, and wherein the channel bar segment 46 is one of the adjustable beams 2, as previously described. The channel bar segment 46 may be attached to the stand via nut and bolt means; tack welding could also be used. The support pole 44 has the first end disposed through the tubular sleeves 40, 42.

As seen in FIG. 2B, which is a partial side view of the support pole 44 seen in FIG. 2A rotated 90 degrees, the second end of the support pole 44 has the curved portion 48. As will be explained in greater detail later in the application, the curved portion 48 will be oriented in the direction of the mat. At the end of the curved portion 48 is the eyelet 50, and wherein the eyelet 50 can be used to attach to the net, as will be more fully explained. FIG. 2B depicts the distance "L" from the eyelet to the vertical segment of the pole 44.

Figure 3:
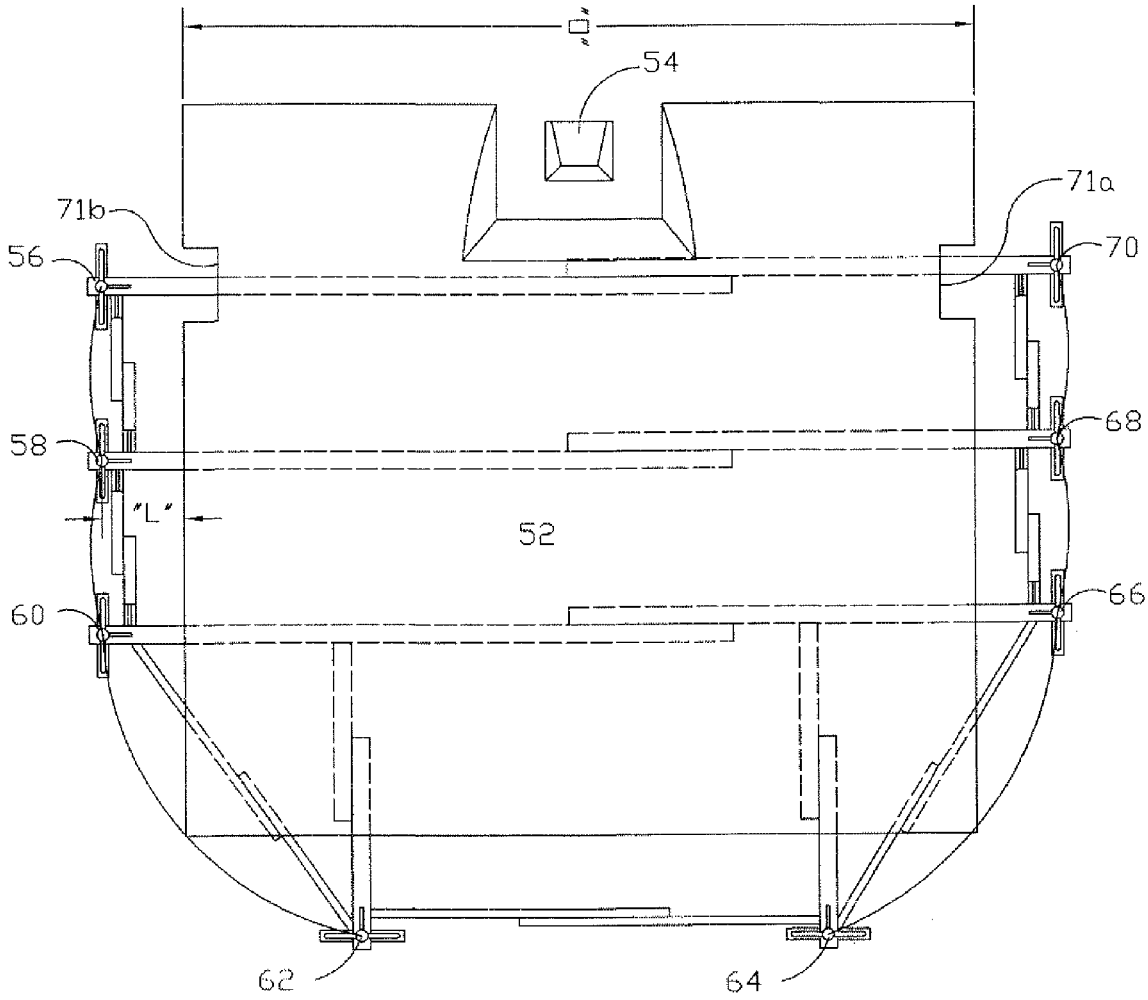
FIG. 3 is a partial top view of a mat placed on top of the base frame seen in FIG. 1.

FIG. 3 is a partial top view of a mat 52 placed on top of the base frame 2 seen in FIG. 1. It should be noted that like numbers appearing in the various figures refer to like components. In FIG. 3, the pole vaulter's planting box 54 is shown, along with the cutaway in the mat 52 so that the planting box 54 can be surrounded on three sides by the mat, as is well understood by those of ordinary skill in the art. FIG. 3 depicts support poles 56, 58, 60, 62, 64, 66, 68, 70 which are placed within their respective stands. The variable length beams are shown in hatched format since the mat 52 is positioned on the top of the base frame 2. As those of ordinary skill in the art will recognize, the cutaway parts 71*a*, 71*b* of the mat near poles 56, 70 represent the location of the standards which support the cross-bars. Note that the support poles 56-70 are set back from the edge of the mat due to the distance from the vertical part of the pole to the eyelet, which is at least the previously discussed distance "L". This distance is allowed due to the curved top portion and allows a distance from the pole to the net so that the vaulter does not hit the support pole while bouncing in the bowl section of the net, as will be discussed in further detail later in the application. FIG. 3 also depicts the three-sided nature of the net since one side will have to be open to allow the vaulter through. The open side corresponds to the side adjacent the planting box 54 and denoted by the letter "O" in FIG. 3.

Figure 4:
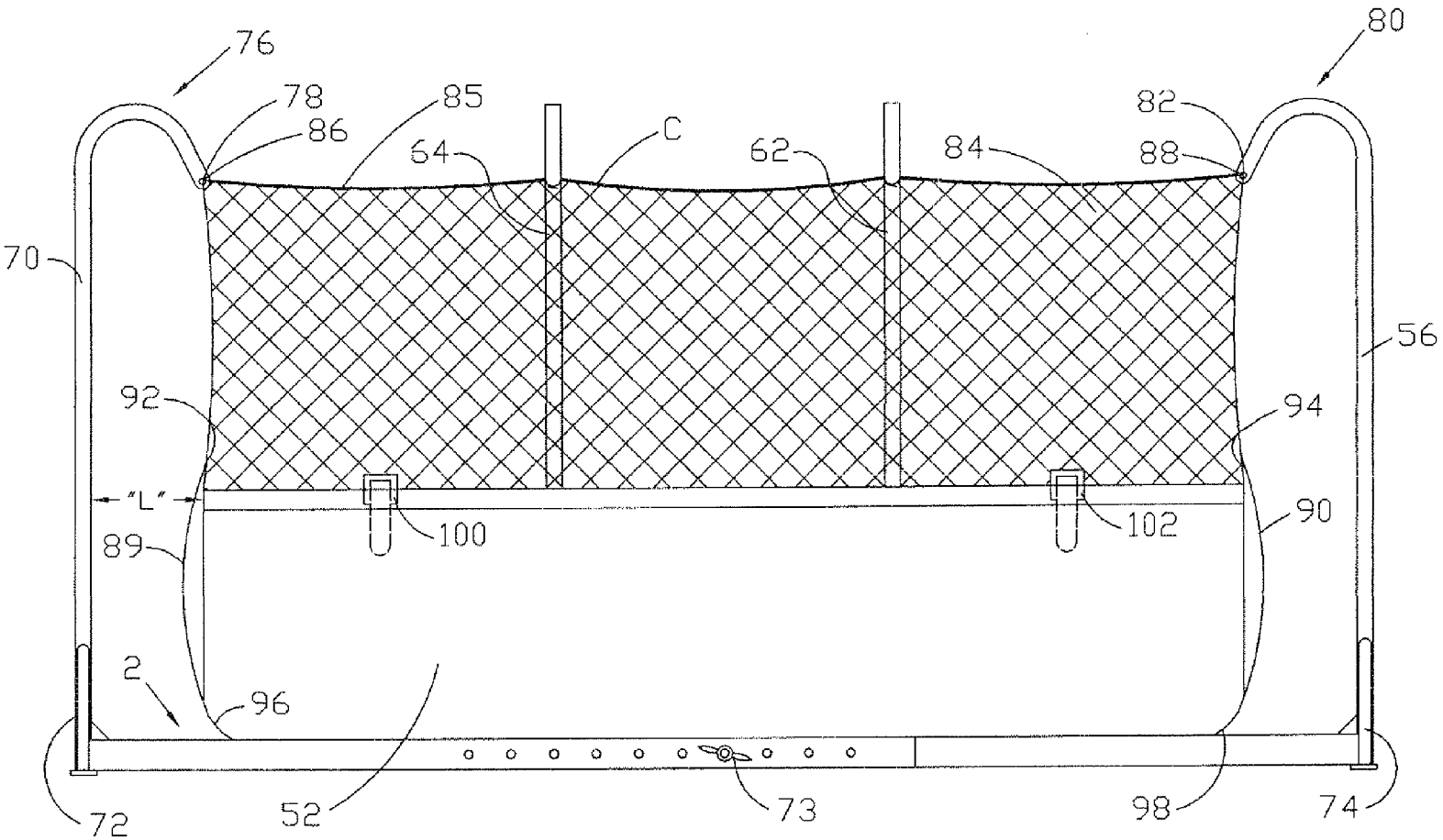
FIG. 4 is a front view of the preferred embodiment of the pole vaulting device of the present invention.

Referring now to FIG. 4, a front view of the preferred embodiment of the pole vaulting device of the present invention will now be described. The support pole 70 is shown disposed within a stand, and where the brace 72 of a support stand is shown and wherein the stand is attached to the base frame 2, using conventional means. The beam members are attached to each other such as seen, at point 73. The support pole 56 is shown within a stand and where the brace 74 is shown and wherein the stand is attached to the base frame, using conventional means. The support poles 62, 64 are also shown in this view. Note that in this embodiment, the distance from the support pole 70 to the edge of the mat is the previously described distance "L". The support pole 70 has the curved portion 76 with eyelet 78, and the support pole 56 has the curved portion 80 with eyelet 82. In one preferred embodiment (not shown), there may be three layers of mats. Other mat configurations are possible such as the mats being in blocks that are positioned adjacent each other, with a top blanket covering the mats. The curved portions 76 and 80 are oriented in the direction of the mat 52 so that the vaulter does not strike the poles 70, 56.

FIG. 4 further depicts the net, seen generally at 84. The net 84 has an outer periphery which runs along the top of the net 84, denoted by the numeral 85. According to the teachings of the present invention, the net 84 wilt have at one end a connection to the support poles, and more specifically, to the curved portions. Therefore, the outer periphery 85 of the net 84 will be attached to the eyelet 78 at point 86. Likewise, the outer periphery 85 of the net 84 will be attached to the eyelet 82 at point 88. The outer periphery 85 of the net may have a cable "C" disposed therein, and wherein the cable "C" can be connected to the eyelets. The outer periphery 85 may also be referred to as the upper periphery 85. FIG. 4 also depicts the primary strap 89 and the primary strap 90. Additional primary straps may be placed, even though not shown. Essentially, the primary straps 88, 90 will attach at one end (proximal end) to the netting (for instance at point 92, 94) and at a second end (distal end) to the underside of the matting 52, (for instance at point 96, 98). In the most preferred embodiment, the proximal end 92, 94 are at the bottom end of the net 84. The straps may be a nylon webbing strap with buckles, which is commercially available.

As shown in FIG. 4, the mass of the mats 52 act as a weight to anchor the netting 84. Also, with the use of the primary straps 89, 90, the net 84 can be selectively tensioned. In other words, the straps can contain buckle means (not shown) that can selectively place different levels of tension, as desired by the operator. In the preferred embodiment shown in FIG. 4, the netting 84 forms a bowl with three sides. As noted earlier, one of the sides of this netting bowl is missing in order to form a window for passage of the pole vaulter. Hence, as the pole vaulter completes his (or her) jump, the pole vaulter will be held within this bowl. If the pole vaulter bounces into one of the sides of the net 84, the force will be absorbed by the net via its anchor points including the underside of the mat and at the eyelets of the curved portion of the support poles. In other words, the force created by the movement of the vaulter will be absorbed by the net since the net is securely anchored to the underside of the mat in this bowl arrangement seen in FIG. 4. It should be noted that it is also possible to have attaching means for attaching the bottom of the net to the top side of the mat. In the most preferred embodiment, the attaching means will be secondary straps, such as seen at 100, 102 attaching the bottom of net 84 to the top side of the mat 52. Additionally, it is possible to use snaps or clips for secondary straps. It is within the teachings of this invention to allow for a plurality of primary and secondary straps.

Figure 5:
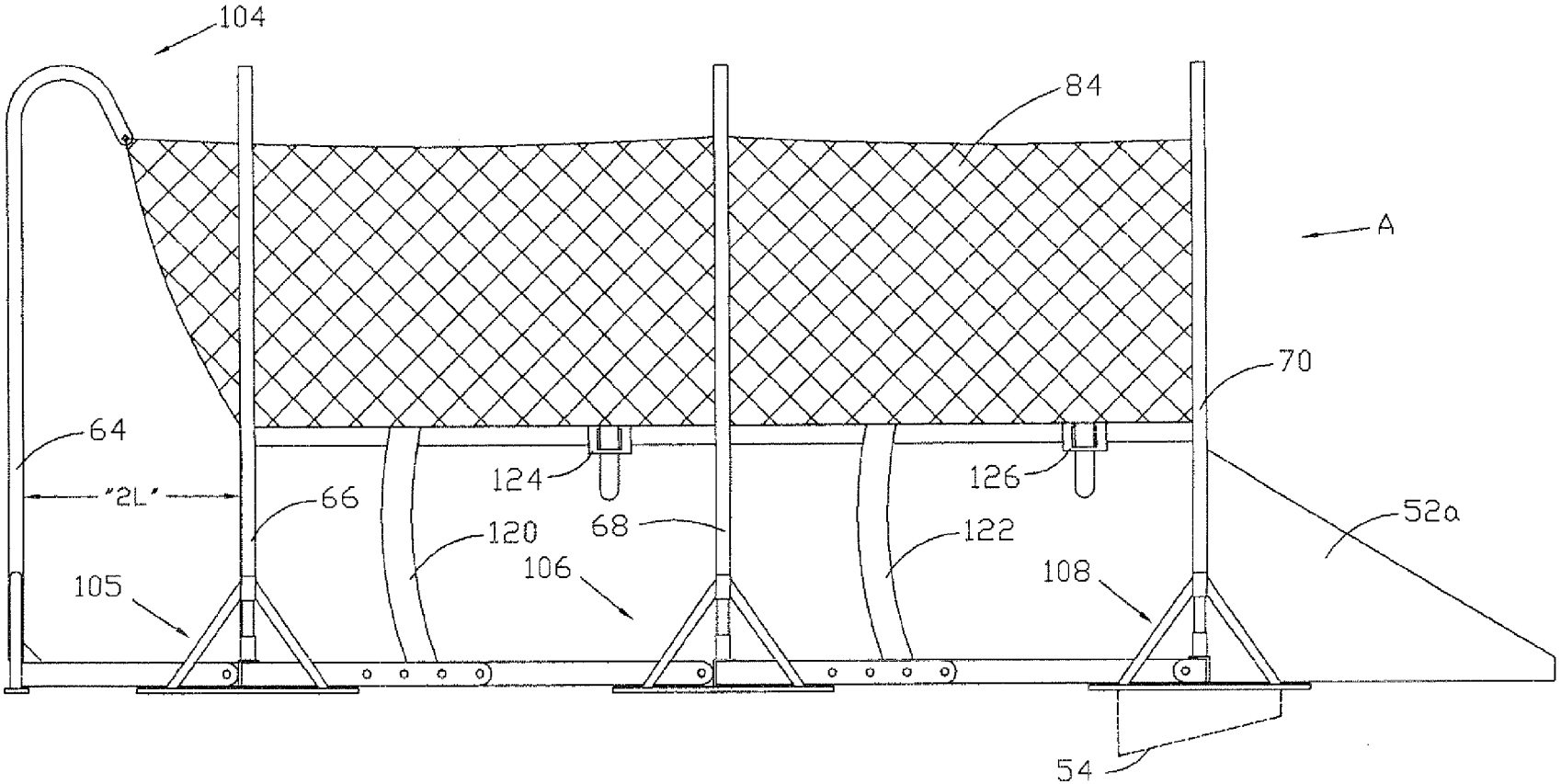
FIG. 5 is a side view of the pole vaulting device of the present invention.

Referring now to FIG. 5, a side view of the pole vaulting device seen in FIG. 4 will now be described. This view depicts the support pole 64 and the curved portion 104 oriented in the direction of the mat 52. The distance "2L" is shown, which is basically twice the previous distance "L" due to the set back area of the support pole relative to the stretched net 84. Due to the curved portion design, if the vaulter is bouncing around the bowl net, the vaulter will not hit the support poles. Also, the support poles 66, 68 and stands 105, 106, as well as support pole 70 and stand 108 are shown. In the most preferred embodiment, all the support poles will have the curved portion. The net 84 is shown having been anchored and tensioned via the underside of the mat, as previously noted. The primary straps 120, 122 and the secondary straps 124, 126 are shown. FIG. 5 also shows the vaulter's planting box 54. The arrow "A" depicts the direction that the pole vaulter would travel. FIG. 5 also shows the mat 52*a* about the vaulter's planting box 54.

Figure 6:
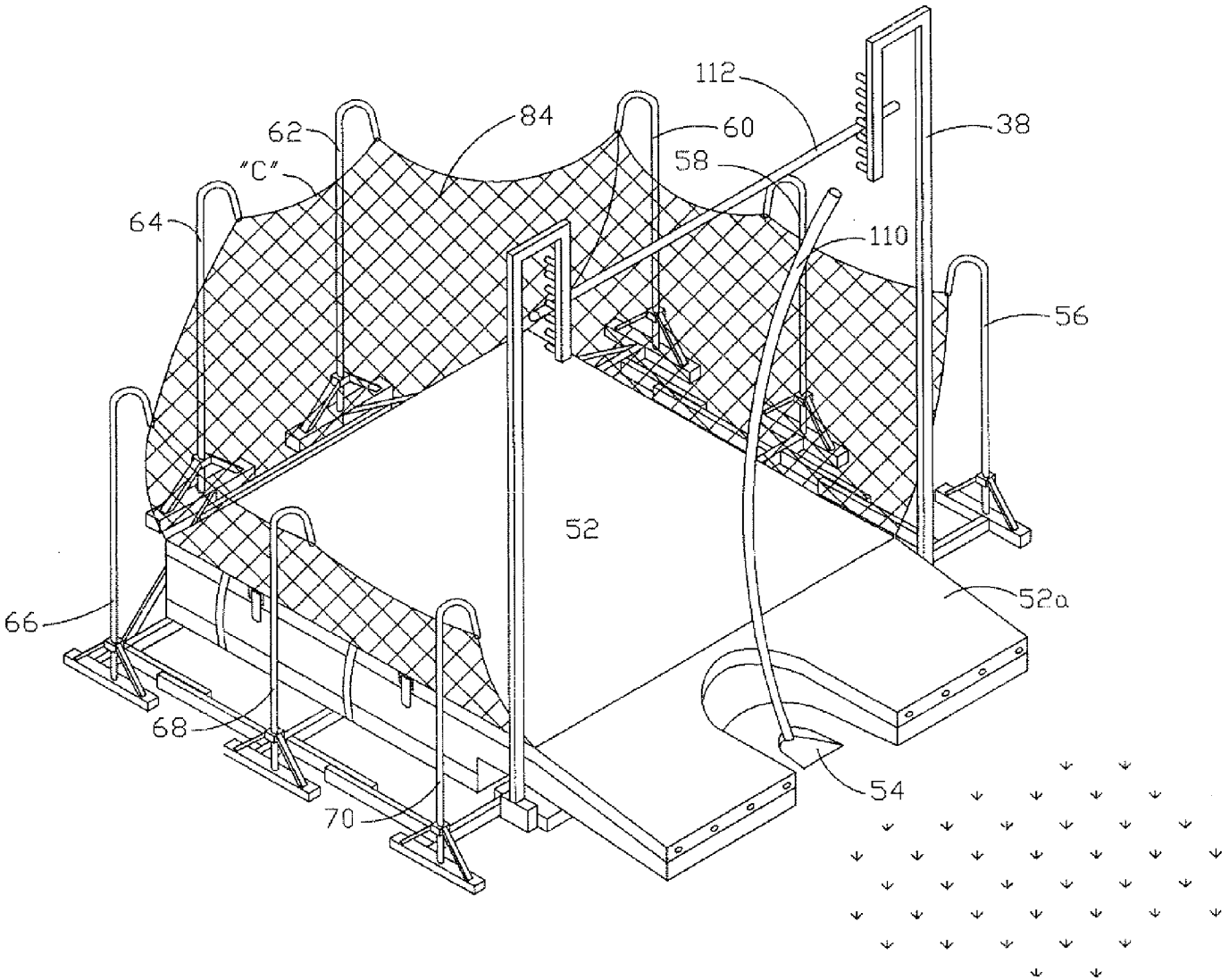
FIG. 6 is a perspective view of the pole vaulting device of the present invention.

FIG. 6 depicts a perspective view of the pole vaulting device of the present invention. FIG. 6 depicts the support poles 56, 60, 62, 64, 66, 68, and 70, disposed within their respective stands, net 84, and mating 52, 52*a*. A pole 110 is in the planter's box 54, A bar 112 has been placed for the pole vaulter, as is well understood by those of ordinary skill in the art. Hence, it can be seen the three sided netting bowl section formed according to the teachings of the present invention. Thus, the force created by the weight of the vaulter against the net will be absorbed, according to the teachings of this invention. FIG. 6 further shows the cable "C" disposed about the outer periphery of the net 84.

Although this disclosure has been described and illustrated certain preferred embodiments of the invention, it is to be understood that the invention is not restricted to these particular embodiments. Rather, the invention includes all embodiments, which are functional, or mechanical embodiments of the specific embodiments and features that have been described and illustrated herein.

I claim:

1. A pole vaulting device for a pole vaulter, wherein said pole vaulter uses a pole to vault over a bar, said device comprising:

a mat having a top side and an underside, said mat including a first cutaway for placement of a planting box, a second cutaway for placement of a first standard for supporting said bar, and a third cutaway for placement of a second standard for supporting said bar;

a plurality of support poles positioned about the mat, said plurality of support poles having a first end;

a meshwork net having an outer periphery, and wherein said net outer periphery is attached to said plurality of support poles, said net being three-sided with an opening that permits the pole vaulter to land on said mat after vaulting over said bar;

a base frame having a longitudinal member and a latitudinal member, said mat being positioned on said base frame;

a plurality of straps having a distal end attached to the underside of said mat, and a proximal end attached to said net so that the net forms a bowl section, wherein said net is attached to the underside said mat and wherein said mat has sufficient weight to anchor said net against the weight of the pole vaulter.

2. The pole vaulting device of claim 1 wherein said longitudinal member comprises:

a plurality of variable length beams.

3. The pole vaulting device of claim 2 wherein said latitudinal member comprises:

a plurality of variable length beams.

4. The pole vaulting safety device of claim 3 wherein said first end of said plurality of support poles has a curved portion, and wherein the curved portion is oriented in the direction of the mat.

5. The pole vaulting device of claim 4 wherein said plurality of support poles has a second end that is selectively attachable to the base frame.

6. The pole vaulting device of claim 5 further comprising:

attaching means for attaching the net to the top side of the mat.

7. A pole vaulting device for a pole vaulter, wherein said pole vaulter uses a pole to vault over a bar, said device comprising:

a mat having a top side and an underside, said mat including a first cutaway for placement of a planting box, a second cutaway for placement of a first standard for supporting said bar, and a third cutaway for placement of a second standard for supporting said bar;

a plurality of support poles positioned about the mat, said plurality of support poles having a first end having a curved portion oriented in the direction of the mat;

a meshwork net having an outer periphery, and wherein said net outer periphery is attached to said curved portion of said plurality of support poles, said net having three sides with an opening that permits the pole vaulter to land on said mat after vaulting over said bar;

a plurality of straps having a distal end attached to the underside of said mat, and a proximal end attached to said net so that said net forms a bowl section;

wherein said net is attached to said underside of said mat and wherein said mat has sufficient mass to anchor said net against the weight of the pole vaulter.

8. The pole vaulting device of claim 7 further comprising:

a base frame having longitudinal member and a latitudinal member, said mat being positioned on said base frame.

9. The pole vaulting device of claim 8 wherein said longitudinal member comprises:

a plurality of variable length beams.

10. The pole vaulting device of claim 9 wherein said latitudinal member comprises:

a plurality of variable length beams.

11. The pole vaulting device of claim 10 wherein said plurality of support poles has a second end that is selectively attachable to the base frame.

12. The pole vaulting device of claim 11 further comprising:

a secondary strap attaching the net to the top side of the mat.

13. The pole vaulting device of claim 12 wherein said support poles are disposed within a stand that is operatively attached to said longitudinal members and said latitudinal members, said stand have a tubular sleeve for receiving the support pole.

14. A method of distributing a force created by a pole vaulter's weight against a meshwork net, the method comprising:

providing a device, the device comprising: a mat positioned on a base frame, said mat including a first cutaway for placement of a planting box, a second cutaway for placement of a first standard for supporting a bar, and a third cutaway for placement of a second standard for supporting said bar; a plurality of support poles positioned about the mat; the net having an outer periphery, and wherein said net outer periphery is attached to said plurality of support poles; a plurality of straps having a distal end attached to an underside of said mat, and a proximal end attached to said net so that the net forms a bowl section having a first side, a second side, a third side, and an opening that permits said pole vaulter to land on said mat after vaulting over said bar;

anchoring said net to the underside of said mat by providing said distal end of said plurality of straps attached to said underside of said mat;

vaulting the pole vaulter over said bar with a pole through said opening in said net;

landing the pole vaulter on the mat;

applying the force caused by the pole vaulter's weight against the first side of the net, said force being created by the pole vaulter bouncing from the mat and into the first side of the bowl section;

distributing the force, caused by the pole vaulter's weight, to the support poles;

distributing the force, caused by the pole vaulter's weight, to the plurality of straps;

distributing the force, caused by the pole vaulter's weight, to the underside of the mat.

15. The method of claim 14 wherein the support poles have a curved portion oriented in the direction of the mat, and wherein said curved portion of said support poles is attached to said outer periphery of said net.

16. The method of claim 15 wherein the base frame has a variable length longitudinal beam.

17. The method of claim 16 wherein the base frame has a variable length latitudinal beam.

18. The method of claim 17 wherein the device further comprises a secondary strap attaching the net to a top side of the mat, and the step of distributing the force of the pole vaulter's weight to the underside of the mat further includes distributing the force caused by the pole vaulter's weight to the top side of the mat via the secondary strap.

* * * * *